US005690394A

United States Patent [19]

Boucherie

[11] Patent Number: 5,690,394

[45] Date of Patent: Nov. 25, 1997

[54] METHOD AND DEVICE FOR PROCESSING BRUSHES

[75] Inventor: Bart G. Boucherie, Izegem., Belgium

[73] Assignee: Firma G.B. Boucherie, Izegem, Belgium

[21] Appl. No.: 627,034

[22] Filed: Apr. 3, 1996

[30] Foreign Application Priority Data

Apr. 5, 1995 [BE] Belgium ..... 09500313

[51] Int. Cl.[6] ..... A46D 1/04

[52] U.S. Cl. ..... 300/2; 300/21

[58] Field of Search ..... 300/2–11, 21

[56] References Cited

U.S. PATENT DOCUMENTS 5,564,789 10/1996 Gerspacher ..... 300/21

FOREIGN PATENT DOCUMENTS 0 078 569 11/1983 European Pat. Off. .

0 458 999 4/1991 European Pat. Off. .

0 639 340 2/1995 European Pat. Off. .

DE 34 15 870 10/1985 Germany .

DE 40 09 584 2/1991 Germany .

DE 44 25 231 9/1995 Germany .

*Primary Examiner*—Mark Rosenbaum

*Attorney, Agent, or Firm*—Bacon & Thomas

[57] ABSTRACT

Method for processing brushes, whereby the brush fibres (2) of these brushes (1) are divided in clearly separated fields and are subsequently treated separately per field. The brush fibres (2) are divided in separate fields by subsequently displacing a number of the brush fibres (2) by bending them by means of one or more displacement elements (5A to 5I), by retaining at least part of the displaced brush fibres (2) in bent condition by means of one or more auxiliary elements (6A–6B–6C), and by redrawing the displacement elements (5A to 5I).

23 Claims, 9 Drawing Sheets

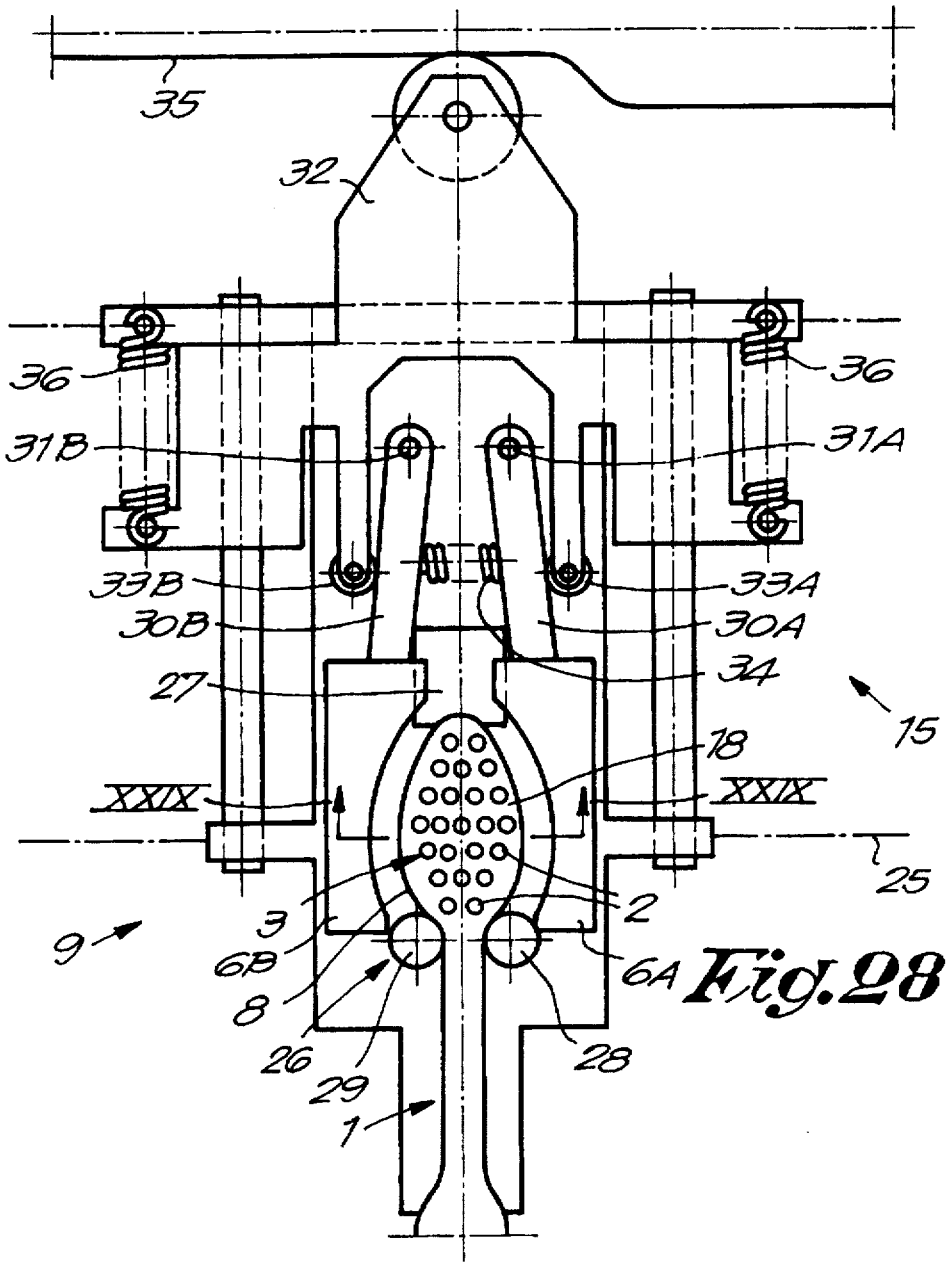
Fig.28
Fig.29
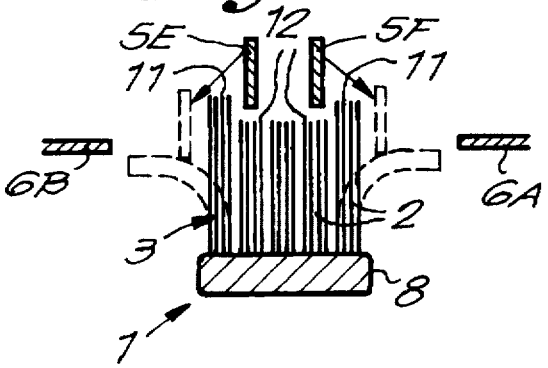
Fig.34
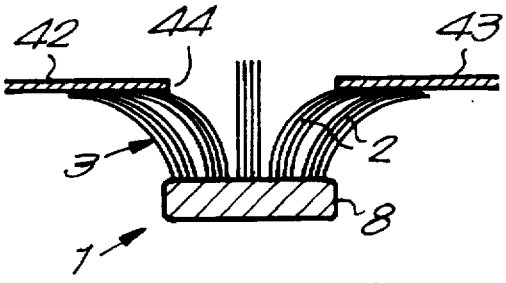

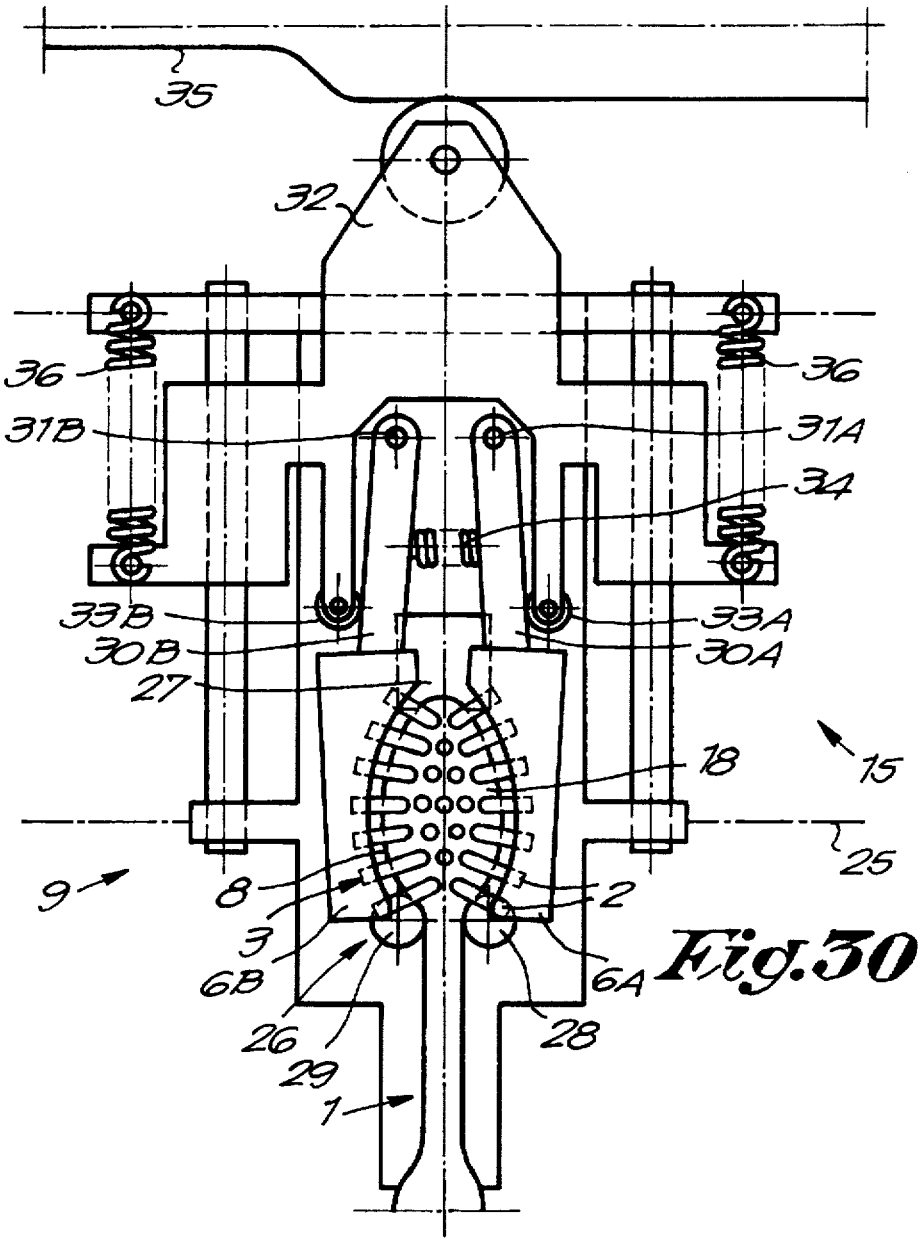
Fig.30
Fig.32
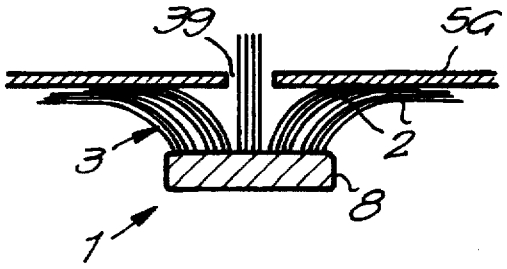
Fig.33
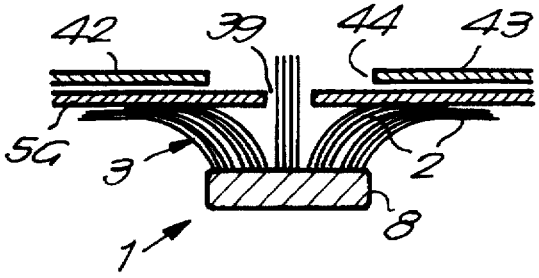

METHOD AND DEVICE FOR PROCESSING BRUSHES

BACKGROUND OF THE INVENTION

The present invention concerns a method and device for processing brushes, in particular for brushes whereby the brush fibres need to be separated and processed in different fields, for example need to be cut and/or warped and/or rounded off at different levels in one and the same machine.

In the first place, the invention is meant for tooth brushes, but in general it can also be used for other brushes.

DISCUSSION OF PRIOR ART

The manufacturing of such brushes is already known from European patent application No. 0.078.569, which deals in particular with the manufacturing of brushes whose fibres have two different lengths.

In the meantime, brushes have been invented whose fibres have more than two different levels. By means of these levels can be simulated certain profiles in the brush field. These profiles can be provided both crosswise and in the longitudinal direction of the brush. These profiles can among others also be convex or concave.

Brushes with such profiles, as well as methods to produce such brushes, in particular finish them, by which is meant warping even and rounding off, are described among others in the patents EP 0.458.999, EP 0.639.340, U.S. Pat. No. 5,165,761, DE 3.415.870, DE 4.009.584 and DE 4.425.231. The methods described herein are little suitable, however, to separate the ever more complicated profiles in clearly distinct fields, or they are very time-consuming as such.

SUMMARY OF THE INVENTION

The invention aims a method and device which make it possible to warp and round off brush fibres of different lengths in an advantageous manner, irrespective of the shape of the profile in the brush field. The starting point hereby is for example that fibres with clearly different lengths are first inserted, such that fields of different height levels are created. At each level, however, there are small tolerance differences as far as the height of the brush fibres is concerned, which are eliminated in the known manner by warping the fibre ends even, which is usually followed by a rounding off or milling operation to remove the sharp edges of the crosscut ends of the brush fibres. The invention in this case aims a particularly advantageous solution to separate the brush fibres of the obtained raw brush in clearly distinct fields, so that the fibres of a field form no hindrance to carry out the warping and rounding off operations to the fibres of another field.

The invention also aims a method and device which makes it possible to divide the brush fibres of a brush in fields, even when they have equal or almost equal lengths. After the division, the brush fibres of the thus clearly defined fields can be subjected to different treatments. It is even possible then to make a brush with different levels out of a brush which is originally provided with fibres of the same length, for example by shortening the fibres of certain fields, by cutting them or by warping them somewhat deeper.

To this end, the invention in the first place concerns a method for processing brushes, whereby the brush fibres of these brushes are divided in clearly separated fields and are subsequently treated separately per field, characterized in that the brush fibres are divided in separate fields by subsequently displacing a number of the brush fibres by bending them by means of one or more displacement elements, by retaining at least part of the displaced brush fibres in bent condition by means of one or more auxiliary elements, and by withdrawing the displacement elements.

The use of separate displacement elements and auxiliary elements is advantageous in that a faultless separation can be obtained. Also, a whole range of possibilities is thus offered, so that any shape of brush can be treated in this manner.

According to a preferred embodiment, the displacement elements are put in contact with the fibres by shifting them sideways, either or not followed by a movement towards the brush body. In particular, the displacement elements will be moved until only the brush fibres to be retained by the auxiliary elements protrude under the displacement elements with slantingly bent ends, so that the auxiliary elements can be positioned against these protruding ends.

Hereby, the auxiliary elements, after the above-mentioned movement of the displacement elements, are preferably presented above the above-mentioned ends in relation to the brush and they are possibly also moved towards the brush body.

Preferably, use is made of displacement elements and auxiliary elements which are adjusted to the shape of the fields to be separated.

In the case of brushes with brush fibres of at least three different lengths, the displacement, the retaining and the treatment are preferably carried out systematically, whereby all brush fibres, to the exception of the shortest, are first displaced and retained, while the shortest are treated, after which these steps are each time successively repeated, whereby the brush fibres of each time a somewhat longer length are step by step released for treatment.

According to the most preferred embodiment, the method is characterized in that the brushes are moved in a transport device, whereby the fibres to be treated each time are at least presented to a warp station and a rounding off station; in that the brush fibres are displaced by means of displacement elements which are erected next to the transport device; in that the brush fibres are retained by means of auxiliary elements which move with the transport device; and in that the brush fibres are permanently retained by the auxiliary elements each time after the displacement until they have been presented both to the warp station and the rounding off station.

The invention also concerns a device, in particular a device which is provided with means to divide the brush fibres of a brush in different fields, so as to be able to treat the brush fibres separately per field, characterized in that the above-mentioned means consist of the combination of at least one displacement element to bend brush fibres and at least one auxiliary element to hold at least a part of the brush fibres bent by the displacement element in the bent shape.

BRIEF DESCRIPTION OF THE DRAWINGS

In order to better explain the characteristics of the invention, the following preferred embodiments are described as an example only without being limitative in any way, with reference to the accompanying drawings, in which:

FIG. 28 shows an embodiment of a part of a device according to the invention;

FIG. 29 shows a section along to line XXIX—XXIX in FIG. 28;

FIG. 30 shows the part from FIG. 28 in another position;

FIGS. 32 to 34 show sections along to lines XXXII—XXXII in FIG. 31, for different positions.

DESCRIPTION OF PREFERRED EMBODIMENTS

Figure 1:
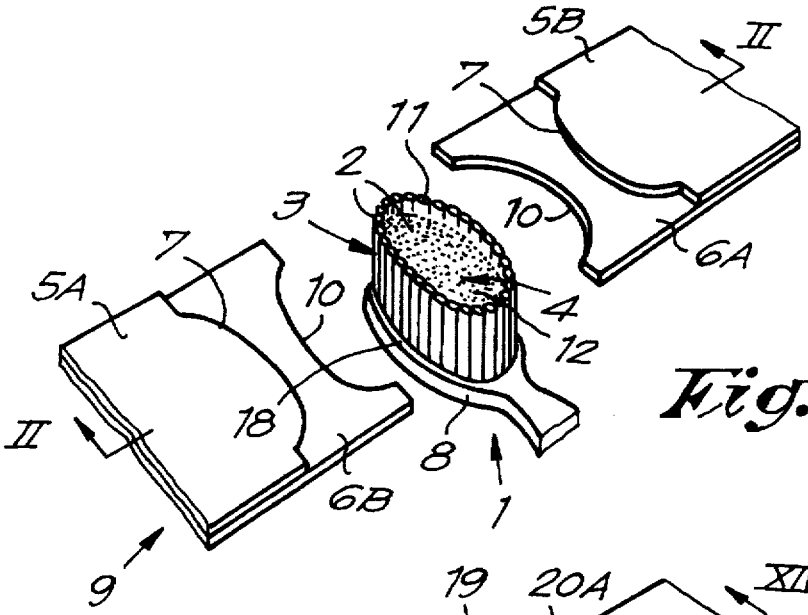
FIG. 1 schematically represents a part of the device according to the invention in perspective.

As is shown in FIG. 1, the invention is related to the processing of brushes 1 which have brush fibres 2 of various lengths. In the example of FIG. 1, the brush fibres 2 of the outermost rows of fibre bundles 3 are longer than the brush fibres 2 of the middle field 4.

In order to be able to process such brushes 1, in particular to be able to warp and round off the brush fibres 2, both the long ones and the short ones, use is made of means to divide the brush fibres 2 in different fields, so that the brush fibres 2 can be treated separately per field. As is schematically represented in FIG. 1, these means according to the invention consist of the combination of displacement elements 5A–5B to bend the brush fibres 2 and auxiliary means 6A–6B to hold at least part of the brush fibres 2 bent by the displacement elements 5A–5B in the bent shape.

In the embodiment of FIG. 1, the displacement elements 5A–5B consist of plates which can be moved sideways which can be pressed sideways with their crosscut ends 7 against the brush fibres 2, such at a required height in relation to the brush body 8 of the brush 1.

The auxiliary means 6A–6B also consist of plates which are situated and/or can be situated on either side of a brush 1 provided in the device 9, and which can be moved sideways towards one another, and which thus can also be put in contact with the brush fibres 2 with their ends 10. In the embodiment of FIG. 1, the auxiliary elements 6A–6B are situated immediately under the displacement elements 5A–5B.

The shapes of the ends 7 and 10 are preferably adjusted to the shape of the fibre fields of the brush 1 concerned, as is clearly visible in FIG. 1.

The working of the device 9, as well as the method used hereby, is represented step by step in FIGS. 2 to 10 and is mainly as follows.

Figure 2:
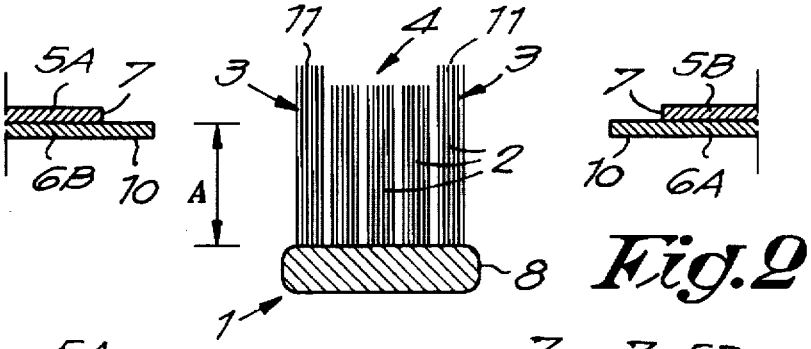
FIGS. 2 to 10 show sections along to line II—II in FIG. 1, for different positions.

FIG. 2 shows the initial position, whereby the displacement elements 5A–5B and the auxiliary elements 6A–6B are situated next to the brush 1, at the height of the brush fibres 2, for example at a certain height A.

As is shown in FIG. 2, we start here in the initial position with fibres which already have different lengths after the filling, which implies that the filling machine has used fibres of different lengths. However, this is not absolutely necessary: the fibres can all have the same length before the displacement is started. Moreover, after the filling, the fibres can either stay unwarped before the displacement starts, or they can be warped before the displacement starts, so that all fibre ends lie in one single field. The latter can be particularly interesting when fibre fields must be warped and/or rounded off at different lengths and when these fibre fields do not consist of individual fibre bundles, but when the fibre fields extend over parts of fibre bundles, for example ½ or ¾ of certain fibre bundles; this implies that a part of the brush fibres of a fibre bundle belongs to the first level, whereas the remaining brush fibres of the same bundle belong to one or several different levels.

Figure 3:
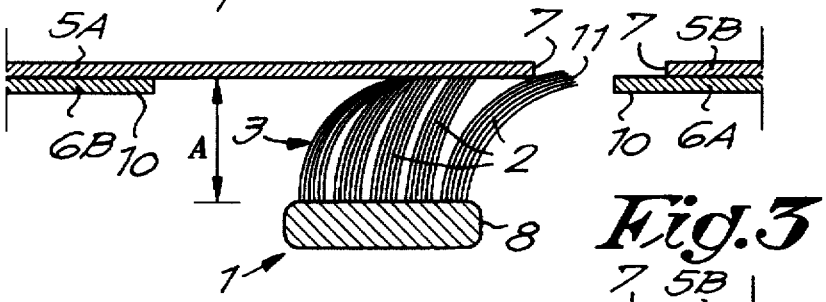
Figure 4:
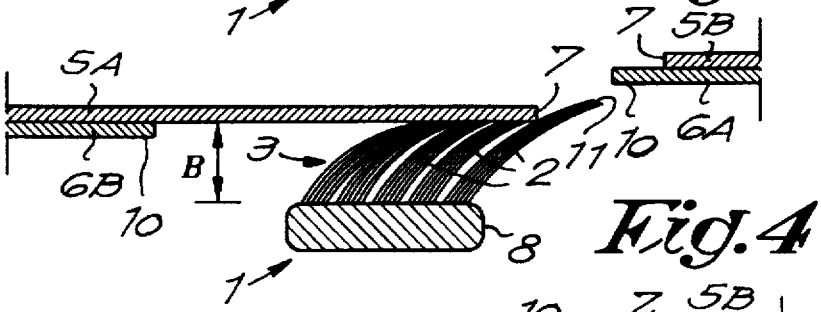

As a first step, the displacement element 5A is pulled out, whereby at least the longer brush fibres 2 are pushed away. This displacement element 5A is hereby moved until a position is reached in which only the longer brush fibres 2, with slantingly bent ends 11, extend from under said displacement element 5A, as is represented in FIG. 3. In order to bring the ends 11 somewhat more outside sideways, the displacement element 5A can possibly be shifted somewhat towards the brush body 8, for example at a distance B, as is represented in FIG. 4.

Figure 5:
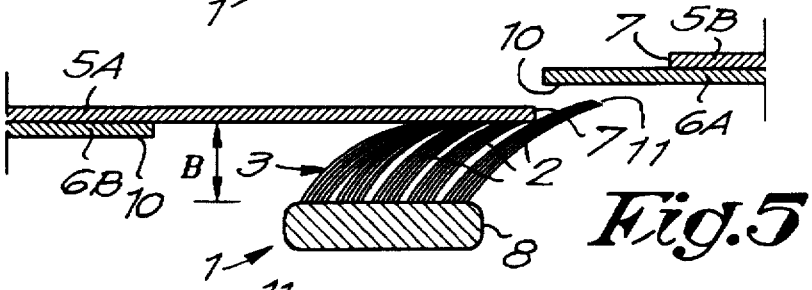
Figure 6:
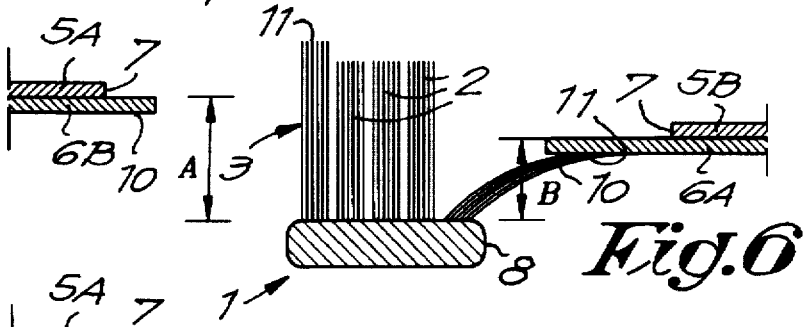

FIG. 5 shows how the auxiliary element 6A is positioned above the free ends 11, after which, as in FIG. 6, the displacement element 5A can be pulled back. In order to obtain an even better separation, the auxiliary element 6A can hereby be moved downward at a distance B from the brush body 8.

Figure 7:
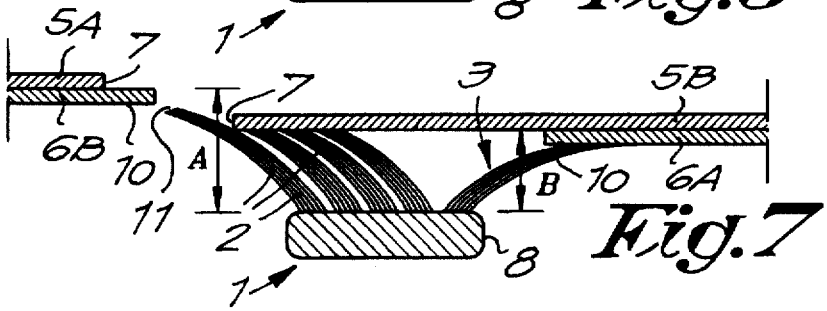
Figure 8:
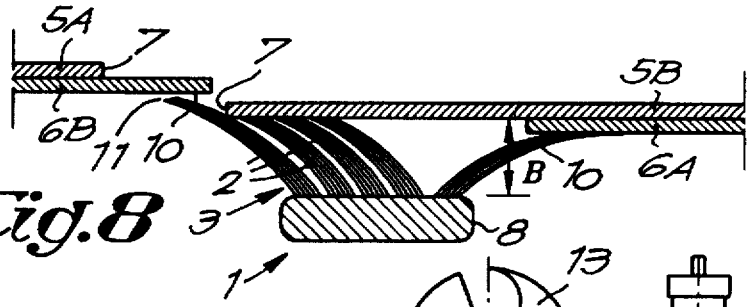
Figure 9:
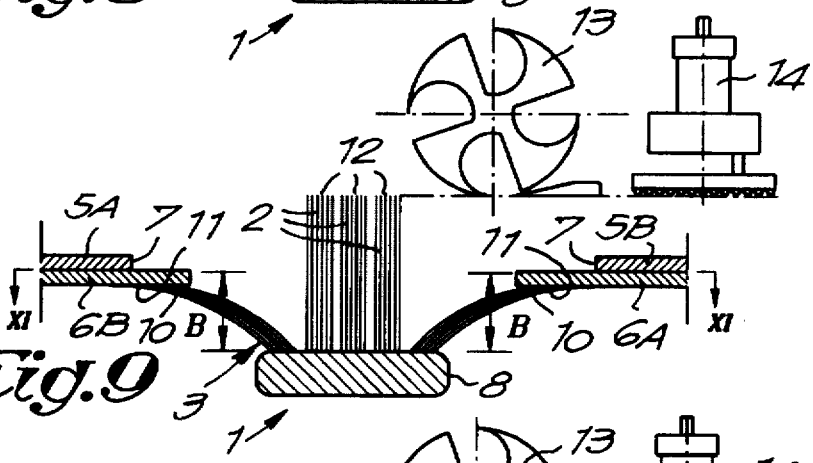

Next, an almost identical scenario is carried out in the other direction, whose steps can be easily derived from FIGS. 7, 8 and 9.

Finally, a situation is achieved as represented in FIG. 9, whereby the longest brush fibres 2 are pushed away sideways and are being held under the auxiliary elements 6A–6B.

In this manner is obtained a clear separation between two fields, in this case the field consisting of the longest brush fibres 2 and the field consisting of the shortest brush fibres 2. In particular, it is now possible to process the ends 12 of the shortest brush fibres 2 without hereby hindering the longest brush fibres 2. As is schematically represented in FIG. 9, the invention is mainly designed to carry out treatments, such as warping and rounding off the brush fibre ends 11, by means of a warp station 13 and a rounding off station 14 known as such. However, it is clear that the invention can also be used in combination with other final processings.

Figure 10:
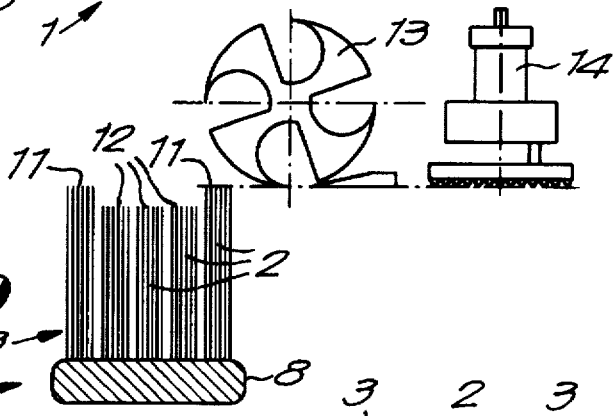

Subsequently, the longest brush fibres 2 are released again, so that they can also be represented to the warp station 13 and the rounding off station 14 as represented in FIG. 10.

The displacement elements 5A–5B and the auxiliary elements 6A–6B are of course equipped with the necessary drive means. It is clear that they can be of different nature. By way of example, two embodiments thereof are represented schematically in FIGS. 11 and 12, in particular of the drive means 15 to move the auxiliary elements 6A–6B.

Figure 11:
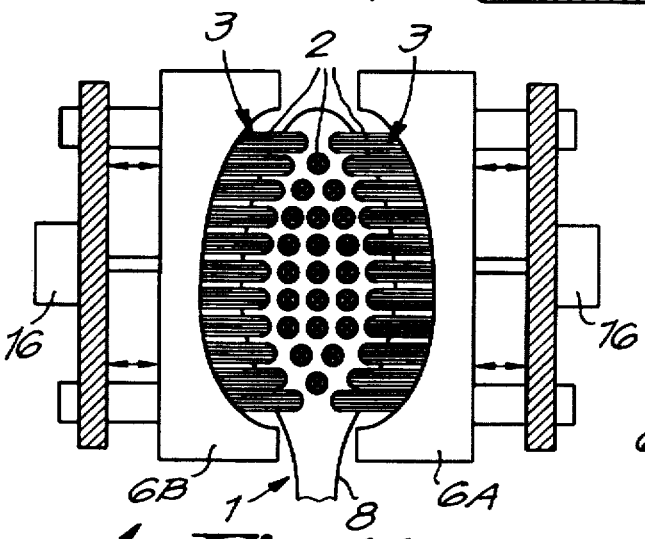
FIG. 11 shows a section along to line XI—XI in FIG. 9, whereby also a drive part is represented.

According to FIG. 11, use is made of auxiliary elements 6A–6B which are made in the shape of carriages which can be moved by means of drive elements 16.

Figure 12:
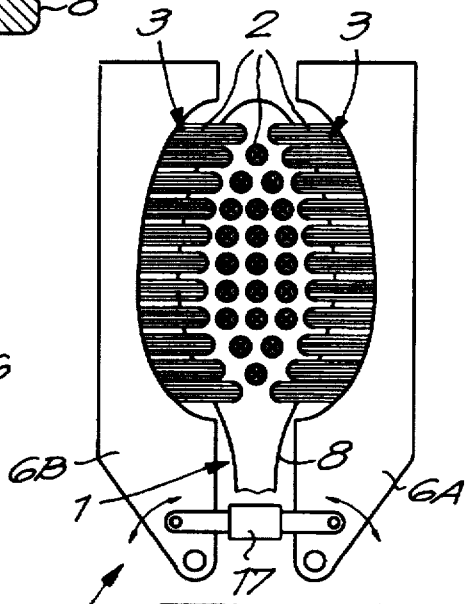
FIG. 12 shows a variant of the part which is represented in FIG. 11.

According to FIG. 12, use is made of rotatable auxiliary elements 6A–6B which can be moved by means of a drive element 17.

It is clear that analogous drive means can be designed for the displacement elements 5A–5B.

Figure 13:
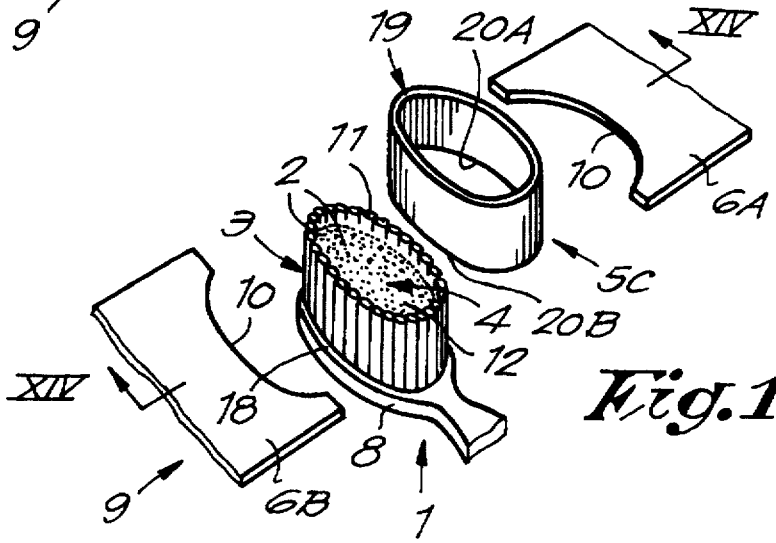
FIG. 13 shows a similar view as FIG. 1, but for a variant of the embodiment.

FIG. 13 shows a variant in which a displacement element 5C is used which mainly consists of a standing wall 19 which extends in relation to the insertion field 18 of the brush 1 to be treated. The shape of the wall 19 is preferably adjusted to the design of the brush fields of the brush 1. According to the most preferred embodiment, the displacement element 5C, and in particular the wall 19, is also made in the shape of a ring as represented in FIG. 13, one and other such that two opposite edges 20A and 20B are formed to displace the brush fibres 2, whereby these edges have the same function as the above-mentioned crosscut edges 7 of the displacement elements 5A and 5B represented in FIG. 1.

Figure 14:
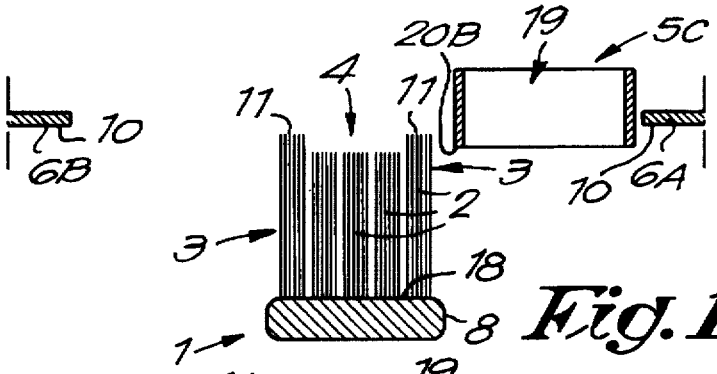
FIGS. 14 to 17 show sections along to line XIV—XIV in FIG. 13, for different positions.
Figure 15:
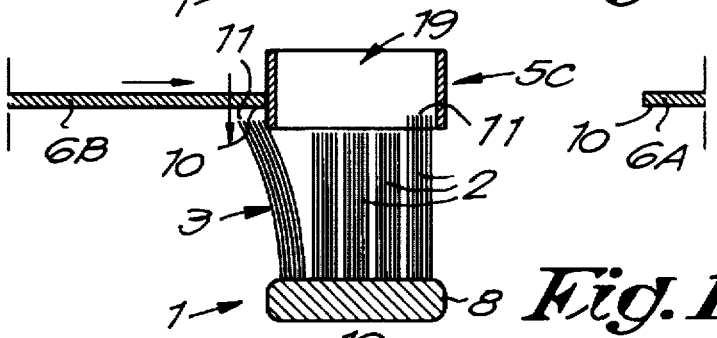

The working of the device 9 of FIG. 13 is schematically illustrated in FIGS. 14 to 17. As is represented in FIG. 14, the displacement element 5C is moved sideways relative to the brush fibres 2 until the above-mentioned ends 11 of a number of the longest brush fibres 2 are bent sideways, such that they can be picked up and held by the auxiliary element 6B as represented in the FIGS. 15 and 16 and analogous to the FIGS. 8 and 9.

Figure 16:
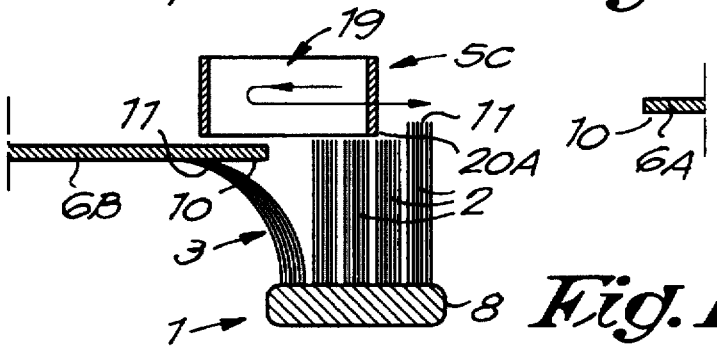

Subsequently, this cycle is repeated in the other direction, as is schematically indicated by means of an arrow in FIG. 16.

Figure 17:
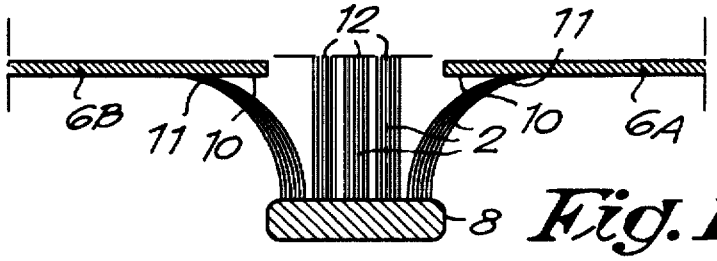

Finally, a situation is reached as in FIG. 17, which mainly coincides with that of the above-mentioned FIG. 9, after which a number of final processings can be done to the smallest brush fibres 2 in an analogous manner.

The use of a displacement element 5C, which consists of a standing wall 19, and preferably in the shape of a ring, is advantageous in that once the wall has moved through a brush field, the brush fibres 2 concerned immediately spring back after said wall has passed, thanks to the limited thickness of the wall 19, and thus do not remain pushed back all the time, which in certain cases, depending on the type of brush fibres 2, could lead to permanent distortions.

When different fields must be separated one after the other, it is clear that one will hereby proceed systematically as a function of the way in which these fields differ. As mentioned in the introduction, preference is given to a method whereby all brush fibres 2 save the shortest are displaced and retained first, while the shortest are being processed, after which these steps are successively repeated each time for the brush fibres 2 which follow in length. This is illustrated in the schematic representations of FIGS. 18 to 22.

Figure 18:
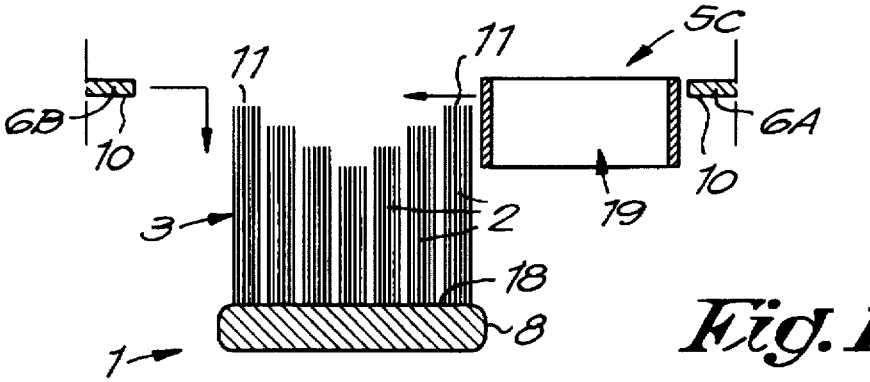
FIGS. 18 to 22 show another special application, at different stages thereof.

FIG. 18 shows how all brush fibres 2, to the exception of the shortest, can be displaced by means of a displacement element 5C. Since the displacement itself is carried out in a similar manner as is represented in FIGS. 14 to 17, not all steps are represented here.

By repeating the steps 14 to 17 on the brush 1 of FIG. 18, whereby the displacement element 5C is each time represented at a different height, the situations of FIGS. 19 to 22 can successively be reached, which makes it possible to successively provide for a final processing of the brush fibres 2 of different lengths.

Figure 19:
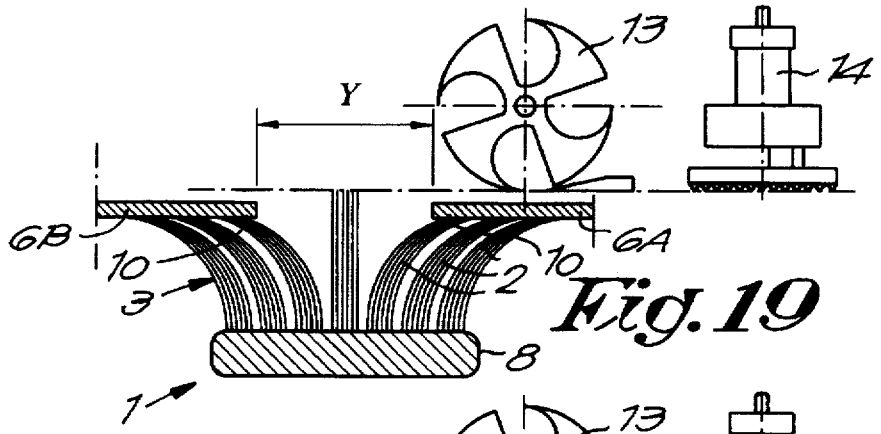
Figure 20:
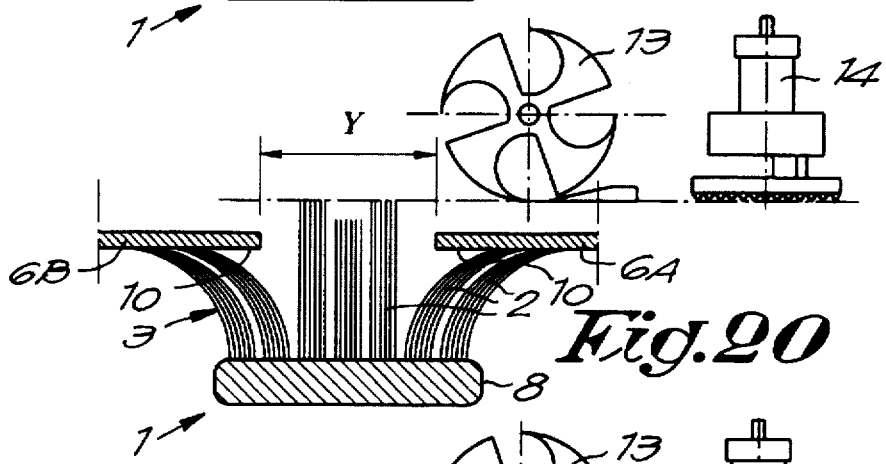
Figure 21:
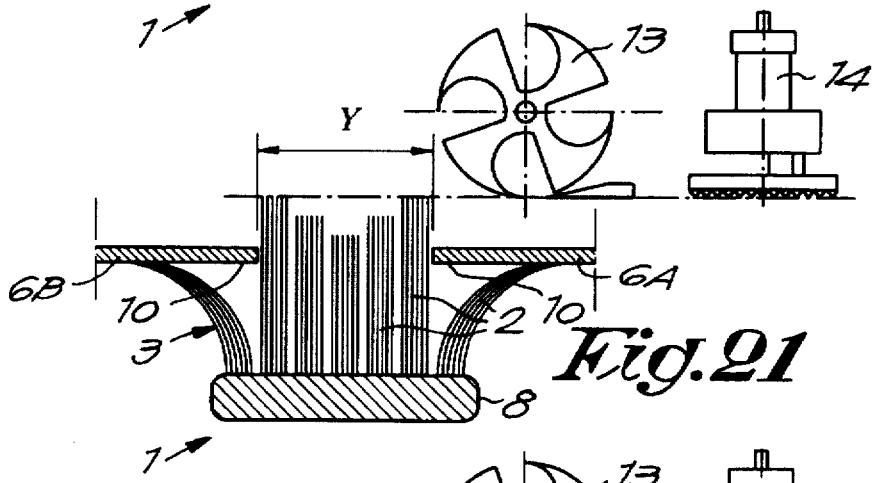

It should be noted that the auxiliary elements 6A and 6B can stand in any position whatsoever at the same distance Y from one another, so that a setting with two positions may suffice for the drive thereof, an open position as represented in FIG. 18 and a somewhat more closed position as represented in FIGS. 19 to 21 respectively.

However, this does not exclude that the auxiliary elements 6A–6B can be adjusted in said and the preceding embodiments between more than two positions.

Figure 23:
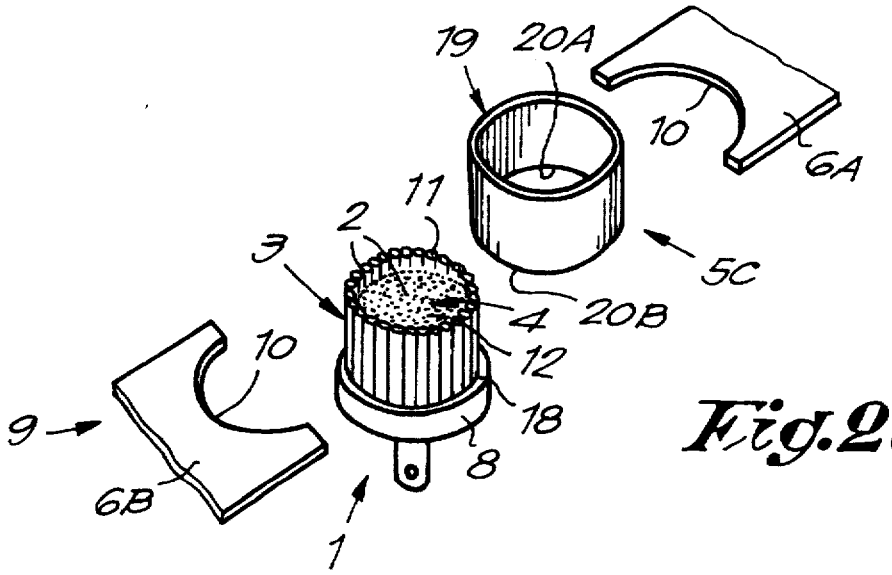
FIG. 23 shows a variant of the part which is represented in FIG. 13.

It is clear that the device 9 according to the invention, possibly with a suitable design of the displacement elements 5A–5B–5C and of the auxiliary elements 6A–6B, is particularly suitable for pushing away rows of fibres or groups of fibres which can have any contour or shape whatsoever. In order to illustrate this, a variant of the embodiment of FIG. 13 is represented by way of example in FIG. 23, which is meant to be used with brushes 1 with a circular brush field. Such brushes 1 are used for example as a rotating brush head in an electric tooth brush. The wall 19 is hereby circular and the crosscut ends 10 are semi-circular.

FIGS. 24 to 27 show a variant which is particularly suitable for brushes 1 with a circular fibre field, but which, with an adjusted design, could also be used for brushes 1 with brush fields in other shapes. What is special here, is that use is made of a displacement element 5D which is mainly formed of an elastic part which can be spread sideways by means of a plunger 21 which can be moved in this elastic part. The displacement element 5D is hereby held in a head 22 which makes it possible to bring the displacement element 5D along the free ends of the brush fibres 2 between these brush fibres 2, by means of a mutual shift between this head 22 and the brush 1.

The displacement element 5D preferably has a profiled edge 23 which partly causes the spreading of the brush fibres 2 that touch it.

The successive steps of the working are illustrated in FIGS. 24 to 27.

Figure 22:
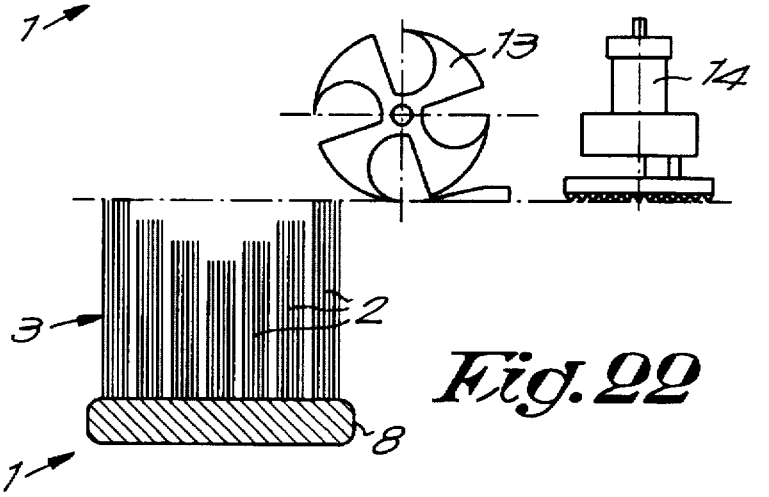
Figure 24:
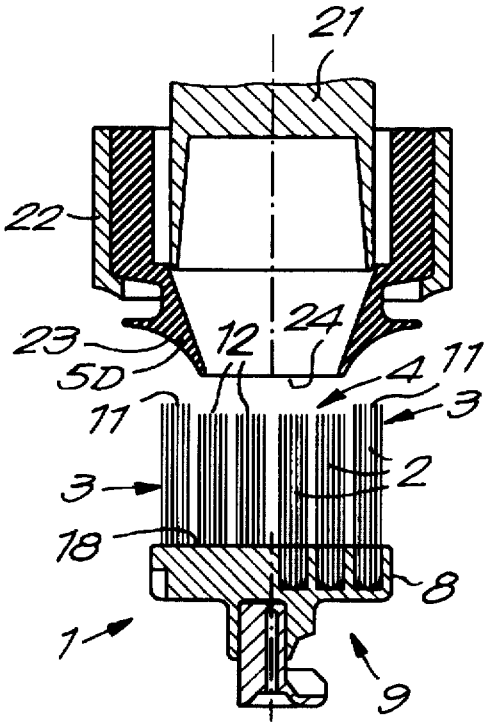
FIGS. 24 to 27 show another embodiment of the invention, for different steps.
Figure 25:
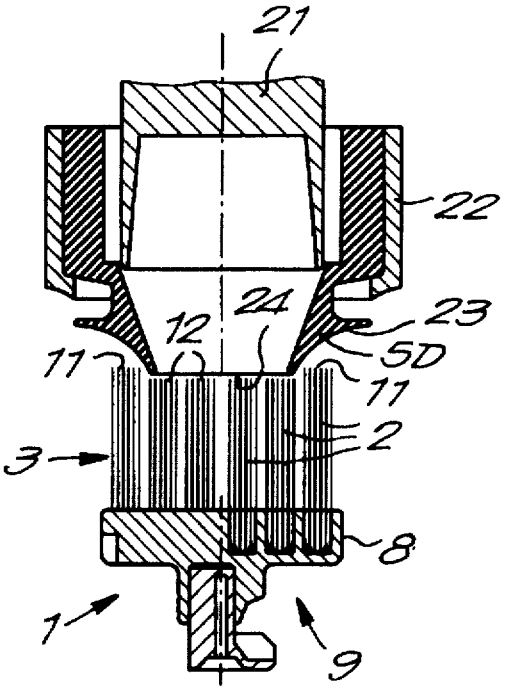
Figure 26:
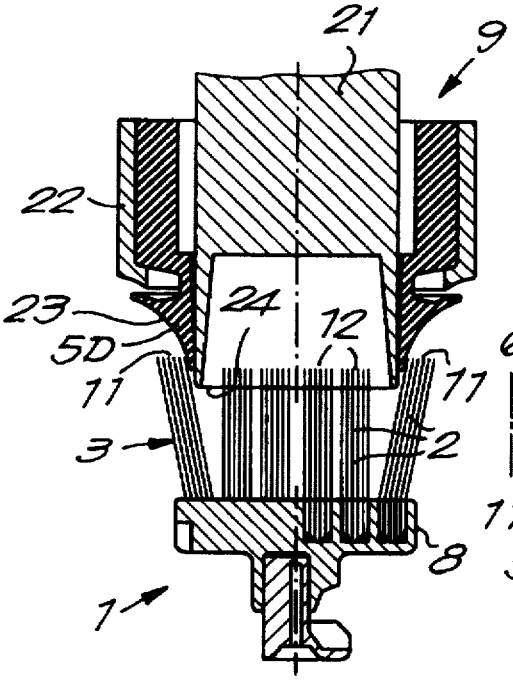
Figure 27:
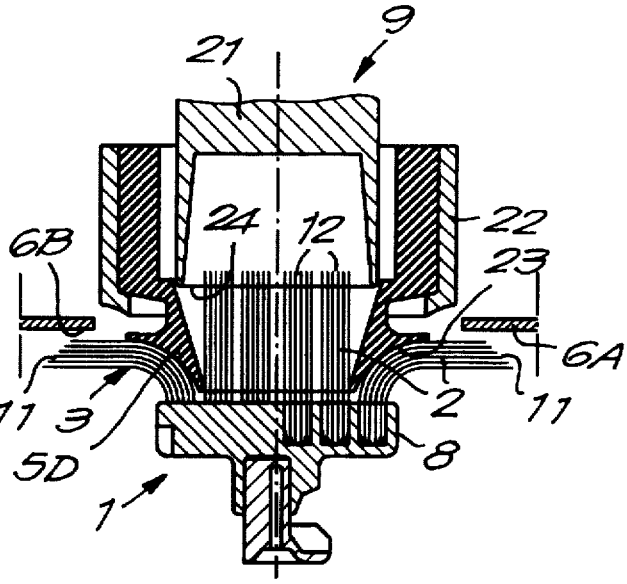

In a first step, the head 22 and the brush 1 are presented on top of one another, as shown in FIG. 22. In a next step, which is represented in FIG. 25, the head 22 and the brush 1 are moved mutually towards one another, for example due to the shift of the head 22, until the bottommost end 24 is situated above the shortest brush fibres 2, but between the longest brush fibres 2. By subsequently extending the plunger 21, the displacement element 5D is spread elastically and the longest brush fibres 2 are also pressed out by the edge 23, as is represented in FIG. 26. By making the head 22 lower further, as is represented in FIG. 27, the longest brush fibres 2 are bent further outward, as they are bent around against the profiled edge 23. Next, the brush fibres 2 can be retained by means of auxiliary elements 6A–6B, the head 22 with the displacement element 5D can be removed again and the final processing of the shortest brush fibres, such as warping and rounding off, can be carried out.

As mentioned in the introduction, the brushes 1 are preferably moved in a transport device, whereby the fibres to be processed are each time successively presented to a warp station and a rounding off station, and preferably, the brush fibres 2 are displaced by means of displacement elements, for example 5A and 5B, which are erected next to the transport device on the one hand, and the brush fibres 2 are retained by means of auxiliary elements 6A–6B which move along with the transport device on the other hand. This offers the advantage that the brush fibres 2, each time after the displacement by the auxiliary elements concerned, for example 6A–6B, can be permanently retained until they have been presented both to the warp station and to the rounding off station.

Also, FIGS. 28, 29 and 30 show an embodiment in which the auxiliary means 6A and 6B as well as the drive means 15 thereof are mounted on such a transport device 25, which for example consists of an endless chain, and are controlled by means of a cam drive.

The brush 1 is hereby clamped in a clamp 26 mounted on the transport device 25, with clamping shoes 27–28–29 as is known among others from EP. 0.078.569.

The auxiliary elements 6A–6B are mounted in a rotating manner on the transport device 25, whereby they can rotate around pivots 31A–31B by means of rolling arms 30A–30B. The drive means 15 to activate the auxiliary elements 6A–6B are formed of a carriage 32 which can act on the rolling arms 30A–30B by means of pressure rolls 33A–33B and can thus push the auxiliary elements 6A–6B towards one another against the force of a spring 34.

The carriage 32 is activated by means of a cam guide 35. The contact between the carriage 32 and the cam guide 35 is hereby ensured by means of springs 36.

Each clamp 26 is equipped with such drive means 15.

The working can be easily derived from FIGS. 28 to 30. FIG. 28 shows the initial situation.

As a first step, the brush fibres 2 concerned, in this case the longest brush fibres 2, are spread by means of displacement elements, in this case 5E and 5F, as represented in FIG. 29. These displacement elements are situated for example frontally above the brush 1.

When the carriage 32 as represented in FIG. 30 is moved, by means of the cam guide 35, the auxiliary elements 6A and 6B close and hold the brush fibres 2 concerned, analogous to FIG. 12.

Due to the movement of the transport device 25, each brush 1 can then be brought under the warp station 13 and the rounding off station 14.

Figure 31:
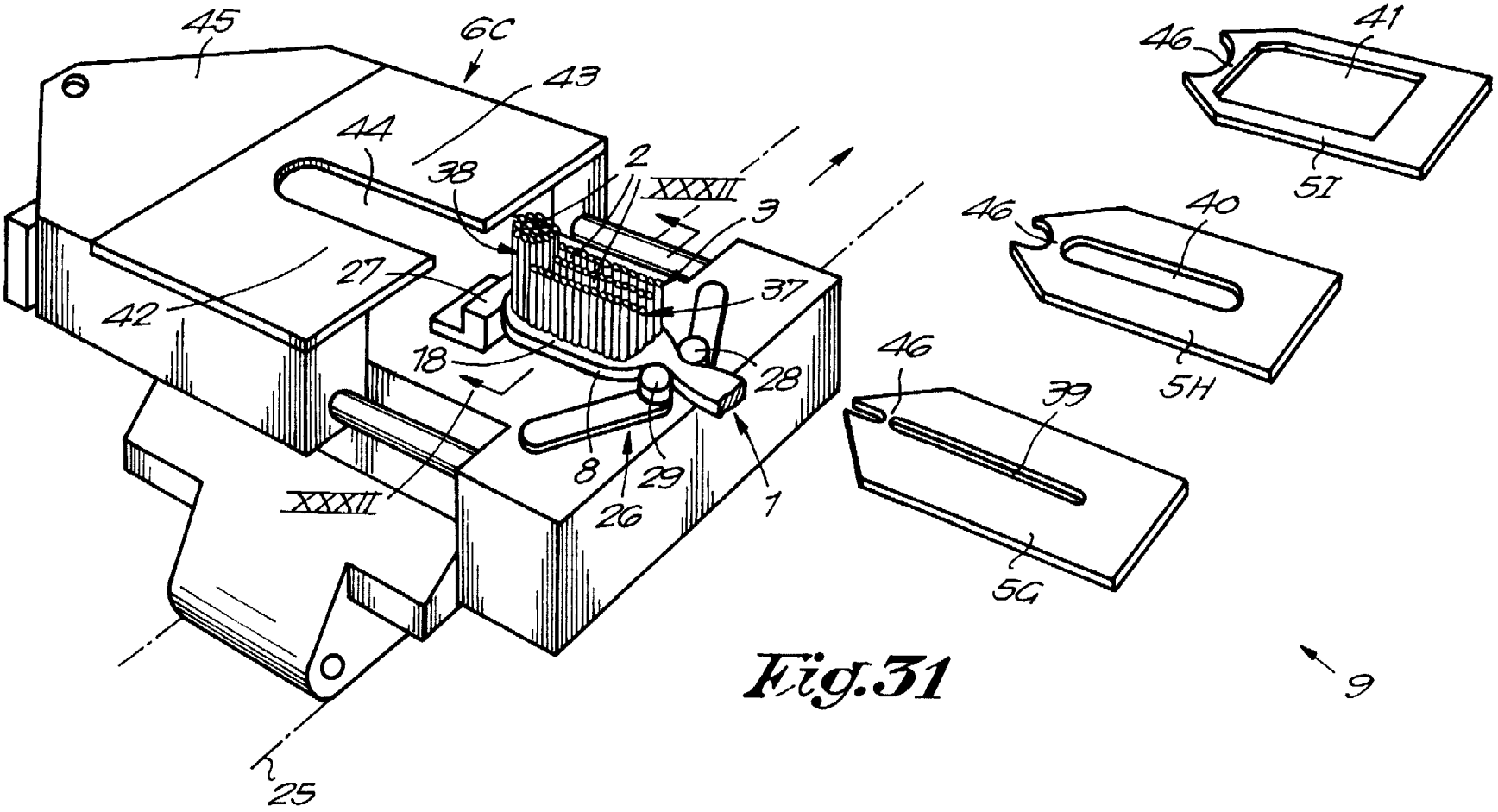
FIG. 31 shows another embodiment in perspective.

FIG. 31 shows another special embodiment with which brushes 1 can be made which have a brush part 37 with a stepped profile in the longitudinal direction, either or not combined with a fibre island 38, which for example defines yet another fibre level.

The device 9 of FIG. 31 is characterized in that this device has at least one displacement element, but in this case several ones, in particular 5G–5H–5I, whereby each displacement element consists of a plate-shaped element which is provided with a recess, 39–40–41 respectively; in that the plate-shaped element is provided with drive means which are not represented in the figure, so as to put it sideways in contact with the brush fibres 2 of a brush 1 put in the device 9, such that certain brush fibres 2 are bent, whereas other, shorter brush fibres 2, are each time put through the recess 39–40–41 concerned; in that it has an auxiliary element 6C with two plate-shaped parts 42–43 which are situated at a fixed distance from one another, in between which is provided a slot 44 of a certain width; and in that the auxiliary element 6C is provided with drive means, such as a carriage 45, which make it possible to shift this auxiliary element 6C in the longitudinal direction of the above-mentioned slot 44, over the displacement element 5G or 5H or 5I which at that time is put in contact with the brush fibres 2.

Hereby, the working is based on the principle as represented in FIGS. 32 to 34. First, the displacement element 5G is slid in the brush fibres 2. As a result, only the brush fibres which fit in the recess 39 remain standing, whereas the other brush fibres 2 are bent under the displacement element 5G and are thus separated and pushed away from the brush fibres 2 which are situated in the recess 39.

At the front of the recess 39 is provide a rib 46 which is placed exactly against the fibre island 38 and pushes it entirely away in the longitudinal direction.

Once this position is reached, the carriage 45 is shifted in the direction of the brush 1, which results in a situation as represented in FIG. 33.

Afterwards, the displacement element 5G can be shifted away again, which results in the condition of FIG. 34.

At that instant, the clamp 26 with the brush 1 provided in it can be moved and can be presented to a warp station and a rounding off station, whereby the shortest brush fibres 2 can then be treated without any hindrance from the longest brush fibres 2, as only the shortest brush fibres 2 protrude through the slot 44, whereas all the other brush fibres 2 are held at the edges of the slot 44 under the auxiliary element 6C.

After the shortest fibres have been treated, the entire cycle is repeated, in this case two more times, whereby the displacement elements 5H and 5I are respectively used.

Finally, the fibre island 38 will be presented under the warp station and the rounding off station.

It should be noted that the auxiliary element 6C can cooperate with all three displacement elements 5G–5H–5I.

It is clear that the auxiliary element 6C has two functions, on the one hand retaining the brush fibres 2 which are bent by a displacement element 5G–5H–5I in a certain position, and on the other hand bringing the brushes 1 from one processing station to another one without any mixing of fields or levels with other fields or levels being possible.

The fact that the auxiliary elements 6A–6B or 6C move along offers the advantage that the same number of fibres is presented under the warp station 13 as under the subsequent rounding off station 14.

It is clear that, according to a variant, the displacement elements can also move along with the transport device and that each brush clamp is provided in this case with moving displacement elements as well as auxiliary elements.

It is also clear that all the above-mentioned devices can also be used to split up the brush fibres of brushes with equal lengths in fields.

The present invention is by no means limited to the embodiments described as an example and represented in the accompanying drawings; on the contrary, such a method and device for processing brushes, in particular for separating brush fibres in different fields, can be made according to all sorts of variants while still remaining within the scope of the invention.

I claim:

1. A method for processing fibre brushes wherein the fibres of the brushes extend lengthwise away from a brush body and are divided into at least two separated fibre fields and then separately treated within such fields, comprising the steps of:

bending the free ends of the fibres of at least one fibre field away from the free ends of the fibres of another fibre field using at least one movable displacement element that is advanced toward the one fibre field into engagement with the free ends of the fibres of said at least one fibre field;

retaining the bent fibre ends in bent condition by at least one auxiliary element;

withdrawing the at least one displacement element from engagement with the ends of the fibres of said at least one fibre field.

2. The method according to claim 1, including moving said at least one displacement element sideways relative to the fibre lengths for carrying out the fibre end bending step.

3. The method according to claim 2, including moving the at least one displacement element towards the brush body after moving said at least one displacement element sideways.

4. The method according to claim 3, wherein said sideways movement of said at least one displacement element is carried out until the ends of the bent fibres are located beneath the at least one displacement element.

5. The method according to claim 4, wherein said at least one auxiliary element is located above and adjacent said fibre bent ends following said sideways movement of said displacement element to carry out said retaining step.

6. The method according to claim 5, wherein said at least one auxiliary element is moved towards the brush body to carry out said step of retaining the bent fibres in bent condition.

7. The method according to claim 1, including dividing the fibre fields of the brush in respective half sections by repeatedly bending and retaining the ends of the fibres of the brush by repeatedly carrying out the advancing movements of the displacement element in two opposite directions relative to the fibre lengths.

8. The method according to claim 1, including using a displacement element that includes at least one sideways spreadable section and moving the displacement element towards the brush fibres until the sideways spreadable section is located adjacent the free ends of the fibres of the one fibre field, the ends of which are to be bent, and then spreading the spreadable sections sideways to carry out the fibre ends bending step.

9. The method according to claim 1, wherein the fibre fields to be divided have a geometric shape, and including the step of using displacement and auxiliary elements that have corresponding geometric shapes.

10. The method according to claim 1, including carrying out the recited steps on brush fibres that are located at equal levels relative to the brush body.

11. The method according to claim 1, including carrying out the recited steps on brush fibres that are located in fields of different fibre levels relative to the brush body.

12. The method according to claim 11, wherein the brush fibres are located in fields of fibres that are at at least three levels, including carrying out the bending and retaining steps such that all brush fibre ends except those of the lowest level fibres are first bent and retained; the shortest fibre ends are treated by a treating device; the next higher fibre ends are released from their bent condition and are treated by a treating device, and so on, until the brush fibre ends at the highest level have been released from their bent condition and treated.

13. The method according to claim 1, including the steps of moving the brushes by a transport device so as to present brush fibre ends to be treated to at least a warp station and a rounding-off station;

locating said at least one displacement element adjacent said transport device;

moving said at least one auxiliary element with said transport device; and carrying out said retaining step until the bent fibre ends have been presented to both the warp station and the rounding-off station.

14. The method according to claim 1, wherein the bent fibre ends are held in bent condition by said at least one auxiliary element while the at least one displaceable element is in an advanced position, and wherein the step of withdrawing the at least one displaceable element from engagement with the ends of the fibers of said at least one fiber field is carried out after the step of retaining the bent fibre ends in bent condition by said at least one auxiliary element.

15. A device for processing brushes having fibres attached to and extending lengthwise from a brush body, said device comprising:

a brush fibre divider for dividing brush fibres into different fibre fields that are to be treated separately per field;

said divider comprising at least one displacement element movable against the fibres of a fibre field of the brush so as to bend the free ends of the fibres of the fibre field sideways of their length; and at least one auxiliary element located so as to retain the bent fibres in their bent condition.

16. A device as claimed in claim 15, wherein said at least one displacement element comprises a plate having a crosscut end and that is movable sideways relative to the fibre lengths such that said crosscut end presses against the fibre ends to be bent.

17. A device according to claim 15, wherein said at least one displacement device comprises an upstanding wall extending parallel to the lengthwise direction of the fibres.

18. A device according to claim 17, wherein said wall is in the form of a ring.

19. A device according to claim 15, wherein said at least one displacement element comprises an elastic element, and a plunger for spreading the elastic element sideways relative to the fibre lengths.

20. A device according to claim 15, including at least two auxiliary elements that comprise plates located on either side of a brush to be processed, said plates being movable sideways relative to the fibre lengths towards each other to retain the bent fibre ends.

21. The device according to claim 15, wherein said at least one displacement element comprises a plate having an opening extending therethrough;

means for moving the plate sideways relative to the fibre lengths to cause bending of said free ends of the fibres of the fibre field and to cause the free ends of an adjacent fibre field to extend through said opening;

said at least one auxiliary device comprising at least two plate-shaped parts located at a fixed distance apart and an elongate slot extending between said parts having a given width; and means for moving said auxiliary device in a direction parallel to the slot length to a position above and adjacent said at least one displacement element.

22. A device as claimed in claim 15, wherein said at least one auxiliary element is located so as to retain the bent fibres in the bent condition after the displaceable element has been moved to bend the fibres of the fibre field and while the fibres of the fibre field are still bent by the displaceable element.

23. A device according to claim 15, including a transport device for moving the brushes;

said at least one auxiliary element being movable with said transport device; and means for actuating said at least one auxiliary element, said means for actuating comprising a cam drive and fixed cam guide.

* * * * *